US007631414B2

(12) United States Patent
Quil et al.

(10) Patent No.: US 7,631,414 B2
(45) Date of Patent: Dec. 15, 2009

(54) METHODS FOR PRODUCING LARGE FLAT PANEL AND CONFORMAL ACTIVE ARRAY ANTENNAS

(75) Inventors: Avery Y. Quil, San Pedro, CA (US); Clifton Quan, Arcadia, CA (US); Alec Ekmekji, Los Angeles, CA (US); Jason G. Milne, El Segundo, CA (US)

(73) Assignee: Raytheon Company, Waltham, MA (US)

( * ) Notice: Subject to any disclaimer, the term of this patent is extended or adjusted under 35 U.S.C. 154(b) by 38 days.

(21) Appl. No.: 11/891,774

(22) Filed: Aug. 13, 2007

(65) Prior Publication Data

US 2009/0044399 A1 Feb. 19, 2009

(51) Int. Cl.
*H01Q 13/00* (2006.01)
*H01Q 17/00* (2006.01)

(52) U.S. Cl. ..... 29/600; 29/601; 29/842; 29/884; 343/700; 343/767; 343/792.5; 343/785; 156/285

(58) Field of Classification Search ..... 29/884, 29/600, 825, 830, 601; 343/767, 746, 700, 343/792.5, 785; 156/285
See application file for complete search history.

(56) References Cited

U.S. PATENT DOCUMENTS

H565 H * 1/1989 Ford et al. ..... 156/286
6,417,747 B1 7/2002 Dearden et al.
6,975,016 B2 * 12/2005 Kellar et al. ..... 257/618
6,992,629 B2 1/2006 Kerner et al.
7,057,563 B2 * 6/2006 Cox et al. ..... 343/700 MS
2005/0046510 A1 * 3/2005 Kerner et al. ..... 333/26
2005/0224954 A1 * 10/2005 Kelly ..... 257/706

* cited by examiner

*Primary Examiner*—Derris H Banks
*Assistant Examiner*—Dan D Le
(74) *Attorney, Agent, or Firm*—Christie, Parker & Hale, LLP

(57) ABSTRACT

Methods for assembling an active array system are described. In one exemplary embodiment, an active subarray panel assembly having a first surface with a first array of electrical contacts and a radiator aperture with an array of radiator structure and an aperture mounting surface with a second array of electrical contacts are assembled together. The first surface of the panel assembly and the aperture mounting surface of the radiator aperture are brought into contact with an adhesive layer including microwave interconnects in a pattern corresponding to the first array of electrical contacts and the second array of electrical contacts so that the adhesive layer is between the first surface of the panel assembly and the aperture mounting surface of the radiator aperture. Pressure, heat and vacuum are applied to cure the adhesive and complete engagement of the microwave interconnects.

13 Claims, 10 Drawing Sheets

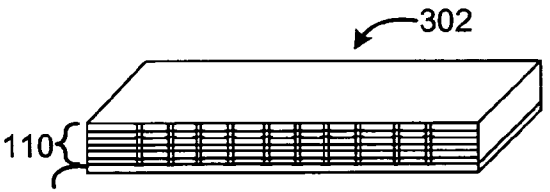
FIG. 2A
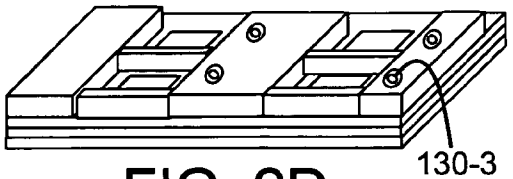
FIG. 2D
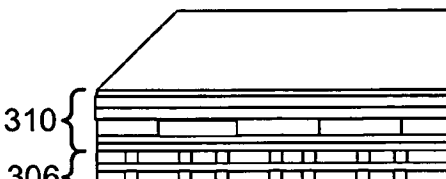
FIG. 2H
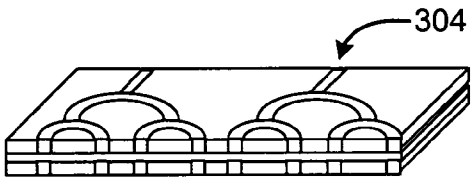
FIG. 2B
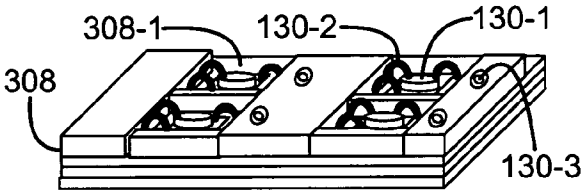
FIG. 2E
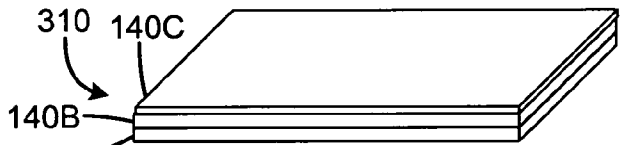
FIG. 2F
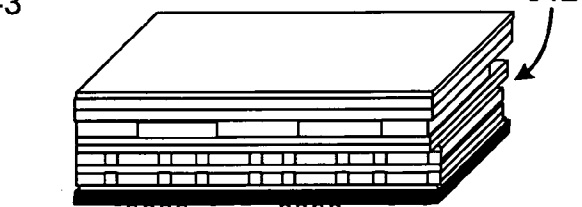
FIG. 2I
FIG. 2C
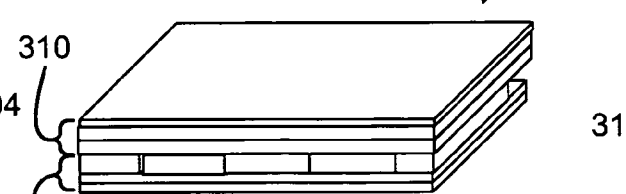
FIG. 2G
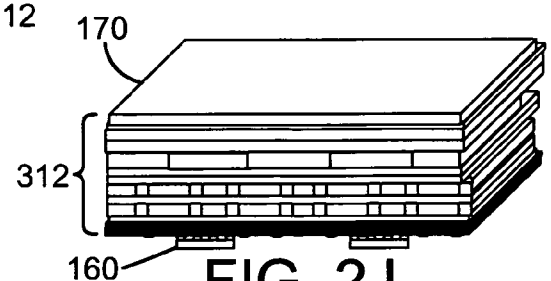
FIG. 2J

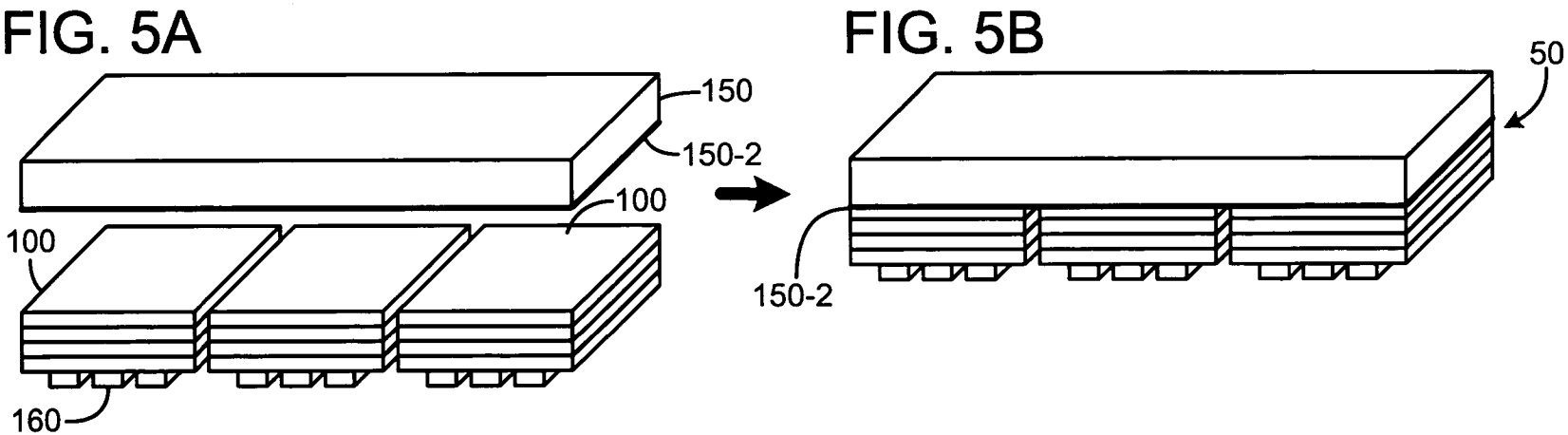
FIG. 5A
FIG. 5B
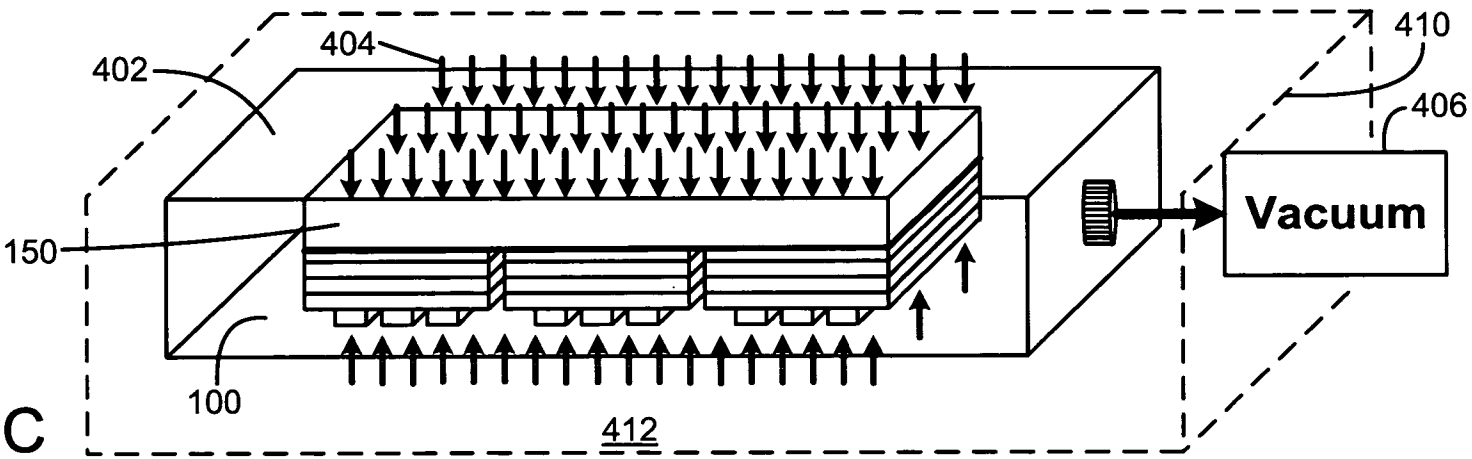
FIG. 5C

METHODS FOR PRODUCING LARGE FLAT PANEL AND CONFORMAL ACTIVE ARRAY ANTENNAS

BACKGROUND

Production of large area active panel array antennas and subarrays with integrated microwave components that can be surface mounted, embedded within the layers or both, presents significant challenges. Panel arrays designs traditionally employ the interconnection of multilayer, multi-function printed circuit board assemblies using discrete RF, DC and ground connections. A large number of interconnections may be required to connect circuitry from layer to layer within a square foot of sub-array. Interconnects for multilayer boards have been achieved with plated through holes. There is a limit to the number of layers that can be built reliably with plated through holes. To achieve a higher number of layers, mechanical type connectors such as spring pins, fuzz buttons or other discrete type connectors may be used. These connectors take up volume, can be expensive and typically employ labor intensive installation techniques.

SUMMARY

Methods for assembling an array system are described. In one exemplary embodiment, an subarray panel assembly having a first surface with a first array of electrical contacts and a radiator aperture with an array of radiator structure and an aperture mounting surface with a second array of electrical contacts are assembled together. The first surface of the panel assembly and the aperture mounting surface of the radiator aperture are brought into contact with an adhesive layer including microwave interconnects in a pattern corresponding to the first array of electrical contacts and the second array of electrical contacts so that the adhesive layer is between the first surface of the panel assembly and the aperture mounting surface of the radiator aperture. Pressure, heat and vacuum are applied to cure the adhesive and complete engagement of the microwave interconnects.

BRIEF DESCRIPTION OF THE DRAWINGS

FIGS. 2A-2J diagrammatically depicts fabrication steps in an exemplary fabrication process for a panel array assembly.

FIGS. 5A-5D illustrates an exemplary process for mounting the active subarray panel assembly onto the aperture using adhesive containing the microwave interconnects.

DETAILED DESCRIPTION

Figure 1:
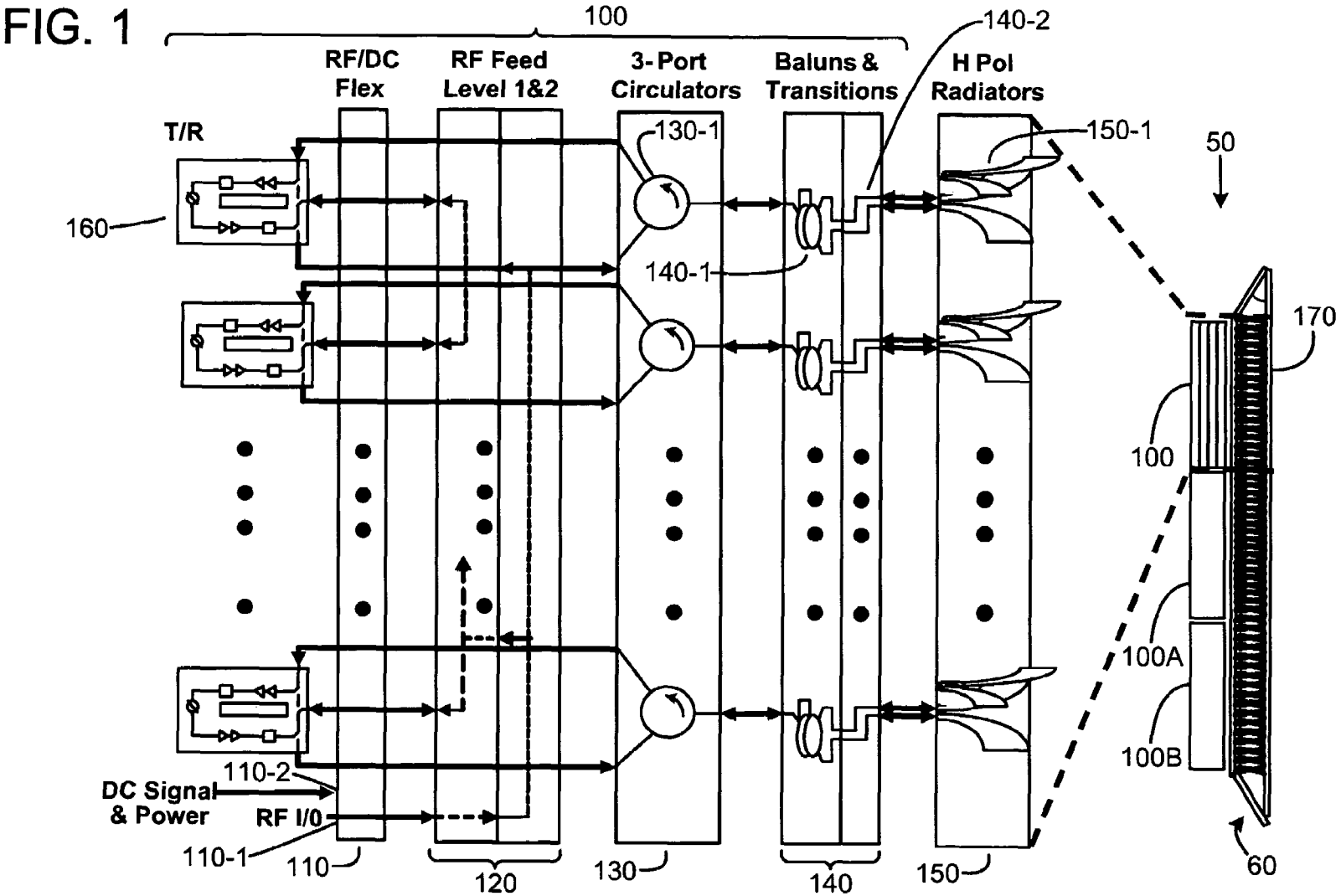
FIG. 1 is an RF functional block of an active panel array antenna depicted as a multilayer assembly with associated RF interconnects.

In the following detailed description and in the several figures of the drawing, like elements are identified with like reference numerals. The figures are not to scale, and relative feature sizes may be exaggerated for illustrative purposes.

Exemplary embodiments of fabrication techniques described below may address the problem of how to produce large area active panel array antennas and subarrays with integrated microwave components that may be surface mounted or embedded within the layers. An exemplary embodiment allows the production of monolithic panel arrays that are structural and which may be integrated to the skin of the aircraft. An exemplary embodiment of a fabrication technique may be applied to produce conformal active panel arrays where the aperture surface is curved as well as flat.

An exemplary embodiment of a fabrication technique may include a lamination technique to build an active panel array antenna using autoclave molding, the realization of microwave interconnects between a layer of the microwave printed circuit boards (PCBs) within the assembly and allowing the presence of transmit/receive (T/R) module MMIC chips during the lamination.

An exemplary interconnection technique is disclosed which may be used to join layers to form subassemblies of differing material, and may be used in a subsequent multiple processes to join subassemblies as post processes. Additionally, an exemplary embodiment of the fabrication technique permits cavities that allow for buried components.

An exemplary embodiment is a conformal load bearing array aperture that may be structurally integrated onto the skin of a vehicle such as a wing structure.

FIG. 1 diagrammatically depicts a functional RF block diagram of features of an exemplary embodiment of an active panel array antenna 50, which includes a plurality of subarrays 100, 100A, 100B . . . , which are assembled to an aperture 60. In an exemplary embodiment, each of the subarrays may be fabricated as a lamination of several layers, in which each layer in turn includes multiple laminas. In an exemplary embodiment, the subarray layers include an RF/DC flexible circuit board layer 110, an RF feed layer 120 which includes two feed levels, a circulator layer 130, and a balun and transition layer 140. T/R module chips 160 may be attached to the RF/DC layer 110. The RF/DC layer may include a subarray RF input/output (I/O) port 110-1, and DC control signals and DC power may be applied to the subarray layer at 110-2. A radiator layer or panel 150 may be electrically and mechanically connected to a plurality of subarrays 100; in this example three subarrays are connected to the panel 150.

In an exemplary embodiment, the layer 120 may be fabricated as a lamination of several dielectric layers. These layers contain printed circuit metal structures that provide RF distribution from a single or multiple input RF signal at RF I/O port 110-1 to a plurality of output signals. The RF transmission lines may be constructed with or without buried cavities and may include buried resistors.

The layer 130 includes a plurality of three-port circulators 130-1, in this exemplary embodiment. The layer 140 includes a plurality of baluns 140-1 and transitions 140-2, to the layer 150, which in this exemplary embodiment includes a plurality of radiator elements 150-1. Functionally there is a one to one correspondence between the radiators, balun and transition, circulator, RF feed, and T/R chips, however routing of circuitry may meander within and between layers to achieve the one to one functional correlation.

In an exemplary embodiment, the radiator elements 150-1 of the panel 150 may include horizontally polarized flared-dipole radiator elements, although other radiator elements may be employed. For example, printed dipole, flare notch and printed monopole elements can also be used, depending on the application.

In an exemplary embodiment, the array 50 includes an outer cover or face sheet 170, which is attached to the radiator layer 150, as generally depicted in FIG. 1. The face sheet 170 may be a structural member, e.g., forming part of an aircraft skin or a radome, and is fabricated of a dielectric material. An exemplary material suitable for the purpose is cyanate ester resin.

In an exemplary embodiment, each printed circuit board core for each of the layers 110, 120, 130, 140 may fabricated using drilled, plated through hole and etch processes to form front to backside interconnects. The plated through holes may be filled with a hole fill epoxy and a cover pad plating of copper may formed at each connection.

In an exemplary embodiment, bond-ply adhesive layers may be drilled with artwork to match the circuit board core interconnect pads, aligned to the pads and tacked to either of the mating cores. The cores may then be filled using a conductive paste filled into holes in the bond-ply adhesive layers that are tacked to the cores. The paste is filled into the holes using a traditional flood fill into a screen and during the filling contacts the copper pads on a core. As described more fully below, the layers are laminated under temperature and pressure to form sintered electrical connections that wets and connect the copper pads each mating board. Once laminated with the interconnect paste sintered, the resulting interconnect is robust enough to withstand many additional post process interconnect processes without degradation.

Figure 1A:
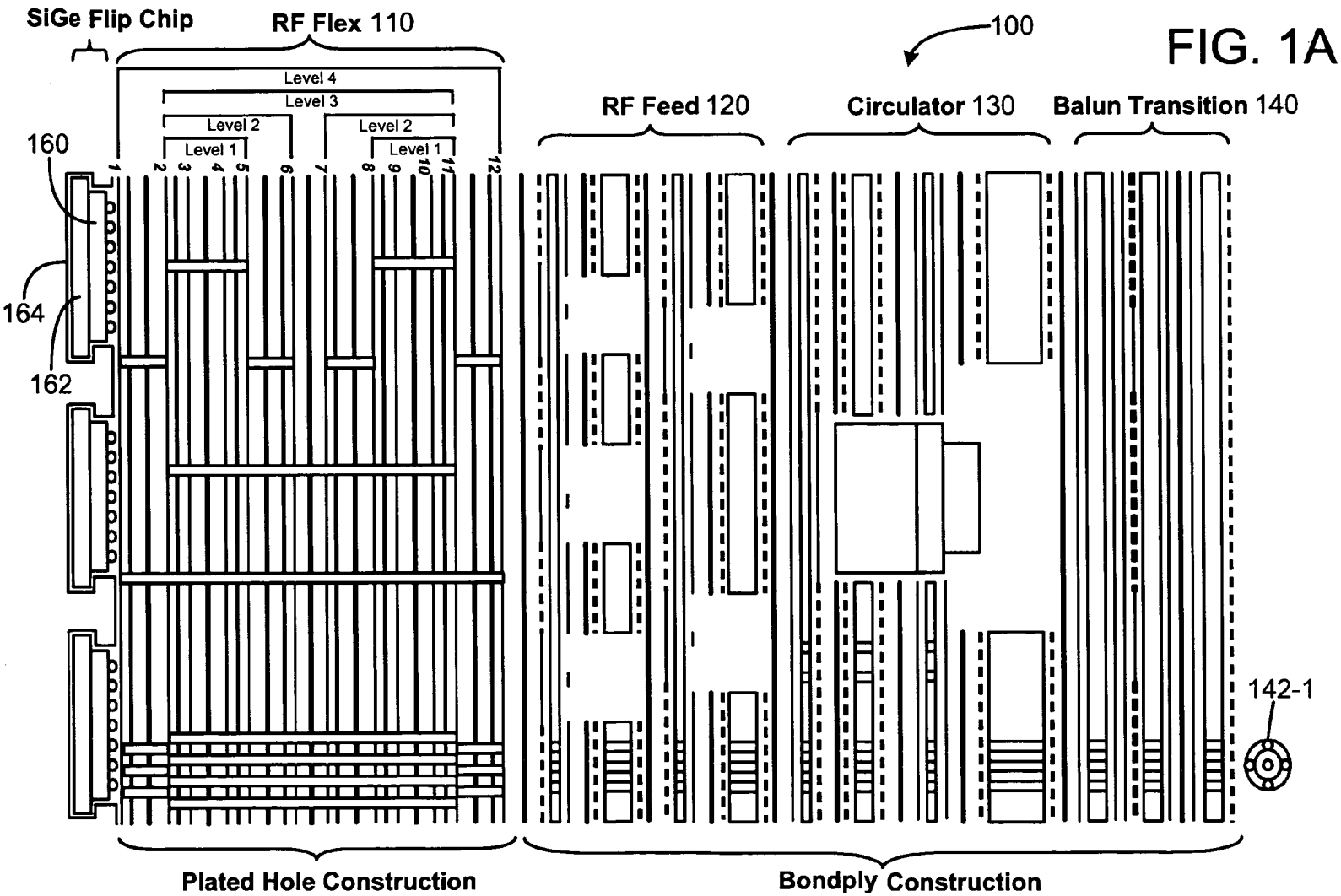
FIG. 1A is a diagrammatic exploded view of a panel subassembly.

FIG. 1A is an exploded side view of an exemplary embodiment of a multilayer sub-array panel 100. The sub-array panel is constructed from several lamina sub-assemblies comprising RF flex subassembly 110, RF feed subassembly 120, circulator subassembly 130 and balun/transition subassembly 140. Each of the sub-assemblies are laminated and electrically interconnected.

In an exemplary embodiment, an autoclave molding process may be employed to laminate the multilayer microwave printed circuit board (PCB) assembly together. This process produces denser, void free moldings because higher heat and pressure are used for curing. Autoclaves are essentially heated pressure vessels usually equipped with vacuum systems into which the bagged lay-up on the mold is taken for the cure cycle. Curing pressures are generally in the range of 50 to 100 psi and cure cycles normally involve many hours. The method accommodates a variety of material and higher temperature matrix resins such as epoxies, having higher properties than conventional resins. While the autoclave size limits part size, the size of commercially available pressure vessels can accommodate panel antennas with much larger sizes and curvatures than what can be accomplished with a conventional laminate press.

The microwave interconnects between the layers in a planar or curved configuration may be realized using either a Z-axis conductive film such as 3M 9703 or selectively screen printable conductive epoxies, solders or electrically conductive sintered paste interconnects such as Ormet™ conductive inks available from Ormet Circuits, Inc., 10070 Willow Creek Road, San Diego, Calif. These materials may be used to make the signal and ground connections in the proper shape and configurations necessary for the interconnect to operate at microwave frequencies when applied using autoclave molding. The microwave interconnects can be implemented within sub-assembles between each layer of lamina, as well as to make inter connections between sub-assemblies. Bondply may be used to adhere the layers together mechanically.

Since autoclave molding accommodates a variety of complex shape and sizes, several multilayer printed circuit board subassemblies may be laminated with their interconnects and with their TR module MMIC chips already assembled onto the PCB surface. The attachment of the TR chips may be performed prior to autoclave molding using conventional automated pick and place equipment and soldering techniques. An underfill epoxy may be applied to the TR chip to prevent the chips from breaking loose from the PCB during the autoclave molding process.

Figure 1B:
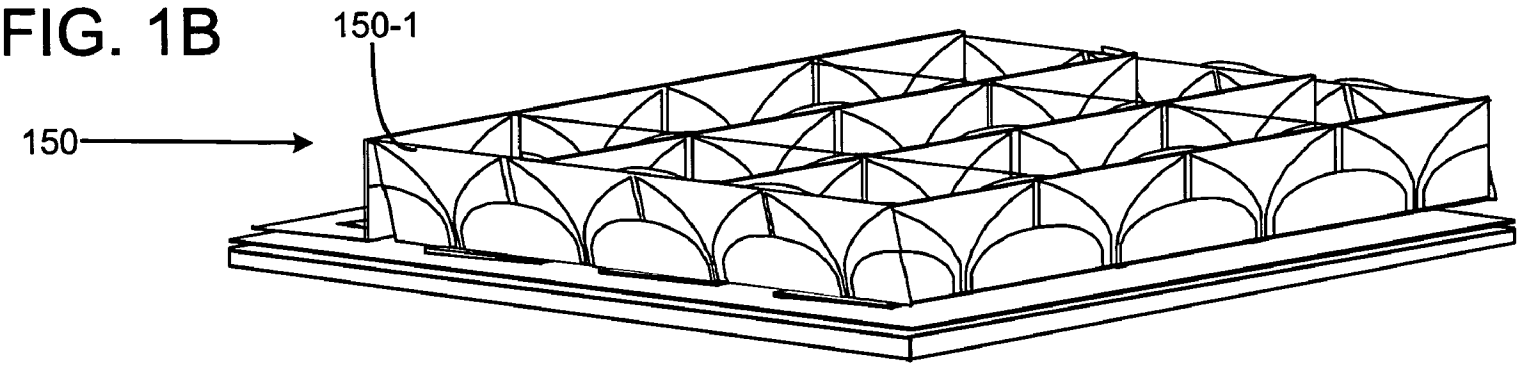
FIG. 1B is an isometric view diagrammatically depicting an exemplary embodiment of a radiator assembly.

In an exemplary embodiment, multiple active subarray panels 100, which for example may range in size from 0.3 square meters to 1 square meter, will be laminated onto the load bearing aperture 60 as depicted in FIG. 1. These multilayer active subarray panels provide DC power, RF signal and digital control signal distribution across the antenna. FIG. 1B depicts an exemplary embodiment of a radiator aperture structure 150, which may be laminated onto a plurality of the subarrays 110. In this embodiment, the structure 150 has an egg-crate configuration, in which the radiator elements 150-1 are flared dipole radiators formed on dielectric layer strips.

An exemplary embodiment of a suitable process for construction and assembly of the active subarray panels 100 is depicted in FIGS. 2A-2J. Single flip chip TR modules 160 may be mounted onto the subarray panel to provide the phase and amplitude weighting across the aperture for beam steering and deformation compensation under various physical loads.

FIG. 2A depicts an exemplary assembly step in the fabrication of a subassembly comprising the RF/DC flex circuits. In this step, a six layer pair of flex circuits are fabricated. A six layer pair has six dielectric cores with conductor layers on both sides of each core bonded with adhesive cores, with drilled and plated vias that form the layer to layer interconnections to form a six layer electrical circuit. These vias can be blind, buried or through interconnections. The flex layers are laminated with a dielectric layer 120-1 from the second level feed included in layer 120 (FIG. 1); the layer 120-1 may be a 10 mil layer of Rogers™ 6002, for example. The lamination may be done using bondply to mechanically adhere the layers, and conductive ink to form the electrically interconnects, at a temperature/pressure of 215° C./300 psi for one hour. In an exemplary embodiment the heat/pressure steps in FIGS. 2A-2J are performed in a vacuum bag inside an autoclave. The result is a first subassembly 302, which is checked for continuity.

FIG. 2B illustrates a fabrication step in which the second level RF feed of layer 120 (FIG. 1) is fabricated from layers of dielectric material, e.g. Rogers 6002 material, with one solid 10 mil thick board and two 30 mil boards with routed channels in an exemplary embodiment. The boards are laminated together using bondply to mechanically adhere the layers, and conductive ink to form the electrically interconnects, at 215° C./300 psi for one hour. The result is a second subassembly 304.

FIG. 2C illustrates an exemplary fabrication step in which the first subassembly 302 (FIG. 2A) is assembled to the second subassembly 304 (FIG. 2B) to create a third subassembly 306. This may be performed by using one layer of bondply to bond a dielectric layer, e.g. Rogers 6002, in the first subassembly to another dielectric layer, e.g. Rodgers 6002, in the first subassembly, at 215° C./300 psi for one hour. The third subassembly 306 is then checked for continuity.

FIG. 2D illustrates an exemplary step of laminating circulator layers to form a fourth subassembly 308. In an exemplary embodiment, several Rogers 6002 circulator boards are fabricated, and laminated using bondply to mechanically adhere the layers, and conductive ink to form the electrically interconnects at 215° C./300 psi for one hour.

FIG. 2E depicts an exemplary step of bonding circulators 130-1 to the fourth subassembly 308 and forming gold ribbon bond interconnects 130-2. This may be done by bonding the circulators into cavities 308-1 in the fourth subassembly, e.g., using Ag epoxy, at 150° C. for one hour. The circulators are then ribbon bond connected to pads on the boards of the fourth assembly, at room temperature. Continuity between bottom and top pads is checked. A set of exemplary top pads 130-3 is depicted in FIGS. 2D and 2E.

FIG. 2F illustrates an exemplary step of fabricating a fifth exemplary subassembly 310 which includes the balun formed by layers 140A,140B, and transition layer 140C. The balun and transition boards may be fabricated from a substrate material such as Rogers™ 4003. The balun and transition boards are then laminated together using bondply to mechanically adhere the layers, and conductive ink to form the electrically interconnects, at 215° C./300 psi for one hour. The balun/transition is formed with two layers 140A, 140B of balun circuitry and a single layer of transition circuitry. The transition layer is the third layer 140C.

FIG. 2G shows the lamination of the fourth subassembly 308 to the fifth subassembly 310, to form a sixth subassembly 312. This may be done using Ormet™ bondply at 215° C./300 psi for one hour.

FIG. 2H illustrates the lamination of the third subassembly 306 to the sixth subassembly 310, forming a seventh subassembly 312. This may be done using bondply to mechanically adhere the layers, and conductive ink to form the electrically interconnects, at 215° C./300 psi for one hour.

FIG. 2I illustrates a step of attaching the T/R module chips 160 to the resultant assembly 312 of FIG. 2H. In an exemplary embodiment, this may be done by dipping solder-bumped chips in flux and reflowing at maximum 210° C. for 30 seconds.

FIG. 2J depicts the step of laminating the radiator face 170 to the assembly resulting from FIG. 2I, and after the subassemblies resulting from FIG. 2I have been laminated to the aperture layer. This may be done using a low temperature, low pressure process to bond the radiator face sheet to the radiators. The radiator face sheet is assembled/attached/interconnected after the sub-assembly panel has been fully laminated.

Single TR flip chip scale packaging and installation onto the antenna panel can be realized using RF on Flex technologies. RF on Flex involves the lamination of multiple layers of thin flex circuit board material (0.5 mils to 5 mils thick) containing the feature pad sizes, vias sizes and pitch to enable a multiple TR flip chips to be mounted directly onto the RF flex board assembly. An exemplary 0.3 square meter subarray panel may contain over 500 TR flip chips at X-band. To ensure the attachment of the TR flip chip is reliable under various physical load conditions, an underfill epoxy is placed underneath the TR flip chip to the RF flex board. A heatsink 162 and a dielectric coating 164 is placed over each mounted chip for thermal management and environmental protection, as depicted in FIG. 1A.

In an exemplary embodiment, individual subarray panel assemblies are bonded and electrically interconnected to a composite egg-crate style radiator aperture to form a very thin, fully integrated active array. An exemplary egg-crate style radiator assembly 150 is depicted in FIG. 1B, and may be constructed of strips of metalized dielectric with a radiator circuitry that is arranged, inter locked and bonded to each other and to a buckskin sheet of dielectric to form a radiating structure. The individual sub-arrays can be tiled, i.e. arranged a continuous and repetitive pattern, to form very large area arrays. The egg-crate aperture provides significant stiffness to the panel array such that it can be used in various integral structural applications. Exemplary applications include airplane wing, fuselage as well as many other surfaces that may carry mechanical loads.

Figures 3A, 3B:
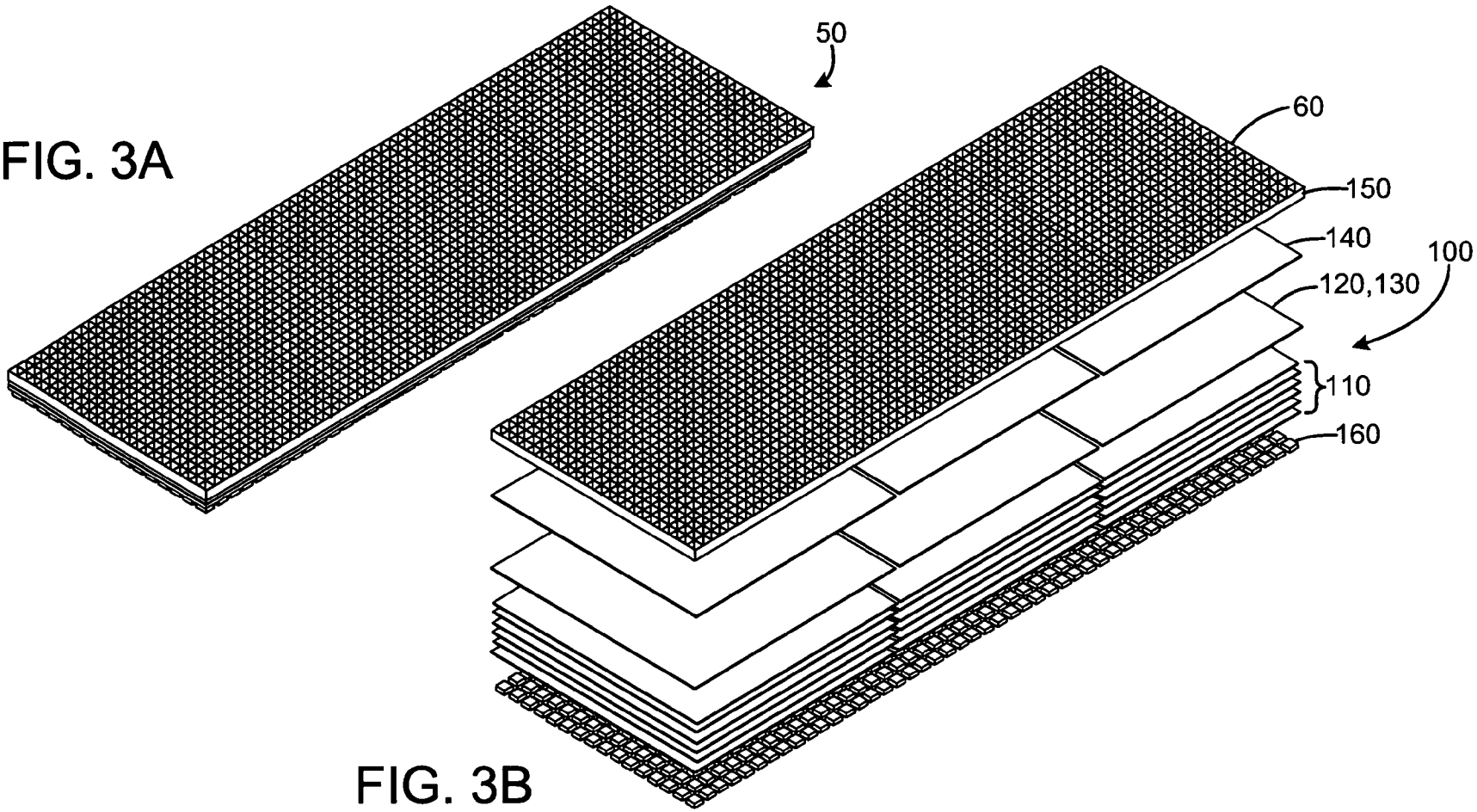
FIGS. 3A, 3B, 3C and 3D depict an exemplary embodiment of an active panel array assembly.
Figures 3C, 3D:
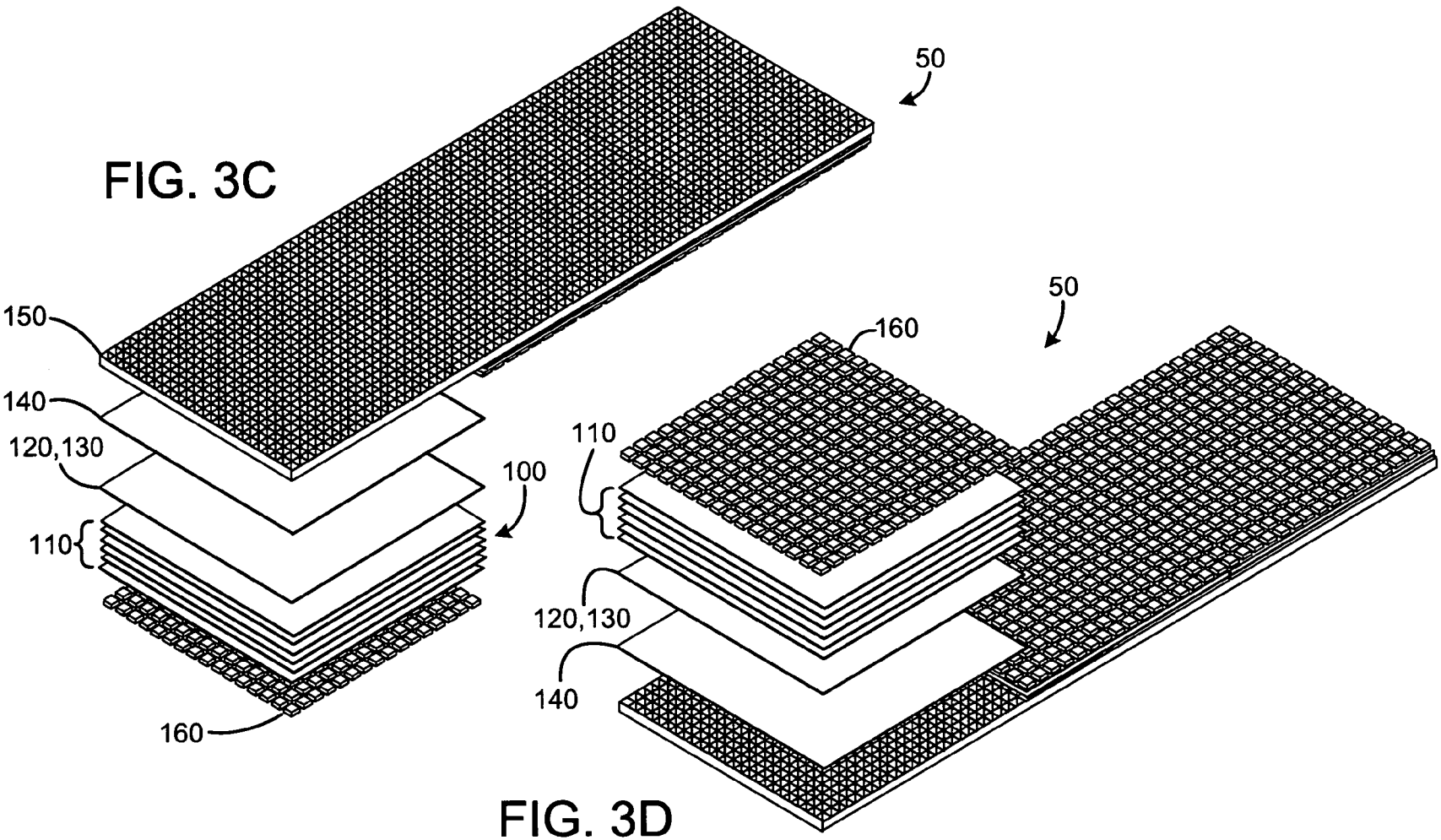

FIGS. 3A, 3B, 3C and 3D show an exemplary embodiment of an active panel array assembly 50. FIG. 3A depicts the assembly in a side isometric view. FIG. 3B depicts the assembly in an exploded side isometric view. FIG. 3C depicts the assembly in a side, partially exploded isometric view. FIG. 3D depicts the assembly in a reversed side, partially exploded isometric view. In this example, the radiator aperture 60 comprising the radiator assembly 150 may be on the order of three feet long by one foot wide. Smaller subarray panels 100 (three subarray panels are shown in FIG. 3B for example) may be bonded to the full size egg-crate radiator aperture 150, should there be manufacturing limitations for the subarray panel assembly. Other embodiments may employ much larger size apertures, e.g., on the order of greater than 40 feet. Although an egg-crate aperture 150 has been described, an exemplary embodiment may be applied to other planar and conformal radiating apertures containing printed patches, stacked disc, cavity backed slots, and continuous transverse stubs (CTS). The exploded views illustrate exemplary T/R module chips 160, the RF/DC flexible circuit layers 110, the RF feed layers and circulator layer, generally depicted as 120, 130, the balun and transition layer 140, and the radiator layer 150.

Figures 4A, 4B, 4C:
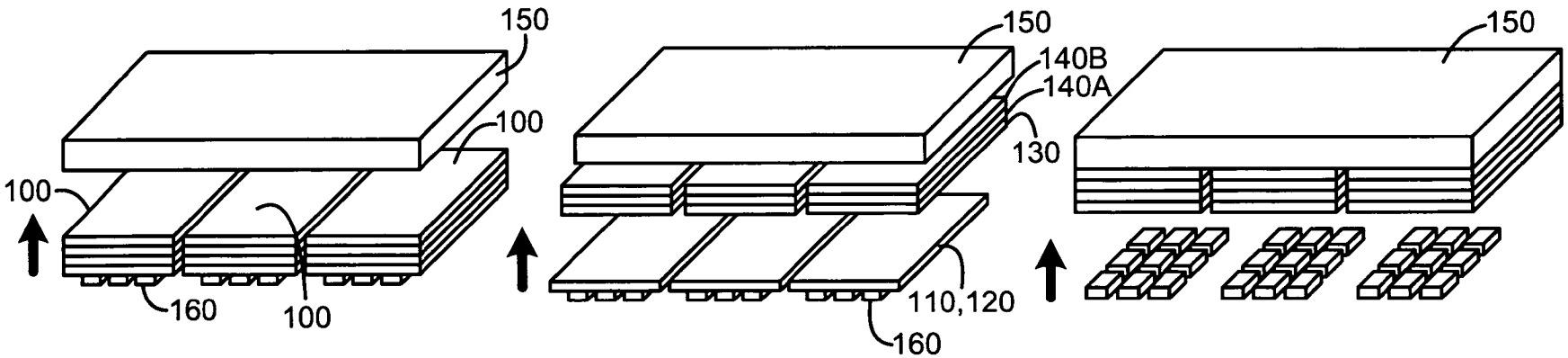
FIGS. 4A-4C illustrate alternate subarray assembly process step hierarchies.

FIGS. 4A-4C depict alternate subarray assembly process step hierarchies. FIG. 4A illustrates one hierarchy, in which the flex circuit layers, the RF feed layer, the circulator layer and the balun and transition layers are assembled together in an assembly, the T/R chips 160 are attached to the assembly to form the panel subassemblies, and then the respective panel subassemblies 100 are assembled to the radiator aperture 150. FIG. 4B illustrates an alternate assembly step hierarchy, in which the T/R chips 160 are attached to the flex circuit layers 110, 120 for each of the panel assemblies. The circulator layer 130 and the balun/transition layer 140A, 140B for each of a plurality of panel assemblies are attached to the radiator aperture 150. The flex circuit layers with the chips are then attached to the subassembly of the circulator, balun/transition and radiator layers to form the array assembly of the aperture and the plurality of panel assemblies. FIG. 4C illustrates another alternate assembly process hierarchy, in which the subassembly of each of the flex circuit layers, the circulator layer, the balun/transition layers, for each of a plurality of panel assemblies, and the radiator aperture are assembled together. The T/R chips 160 are attached subsequently.

Figure 1C:
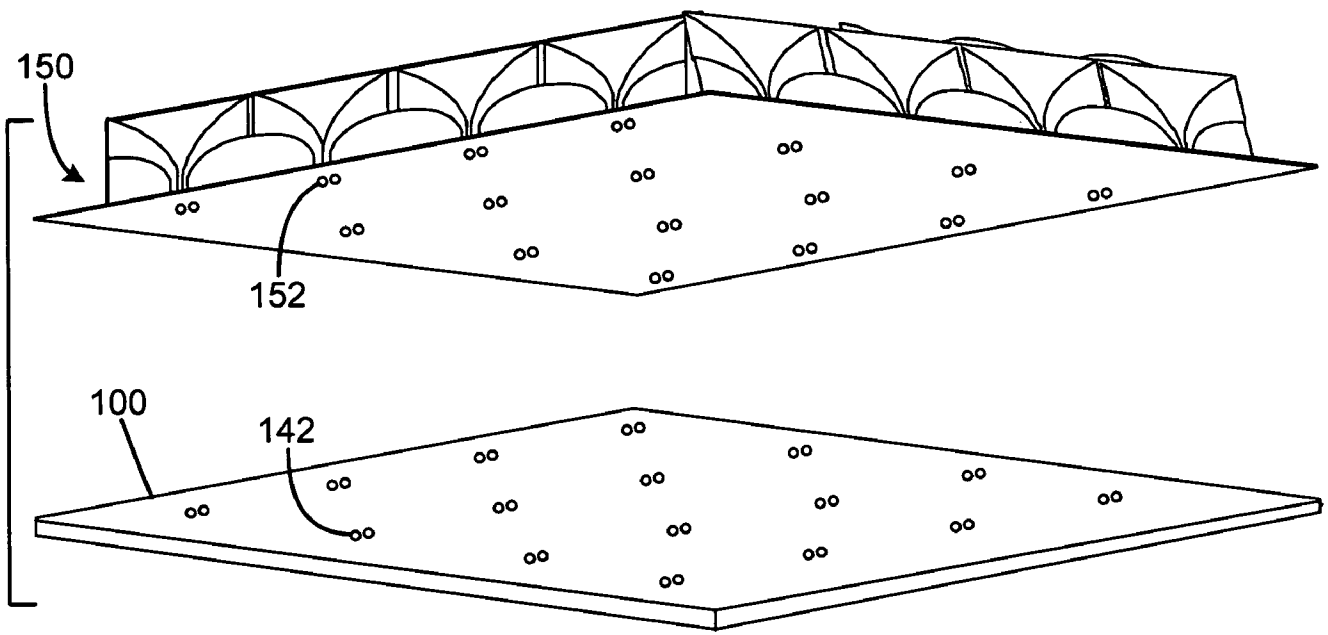
FIG. 1C is an isometric partially exploded view illustrating corresponding sets of contacts on an exemplary radiator assembly and an exemplary panel subassembly.
Figure 5D:
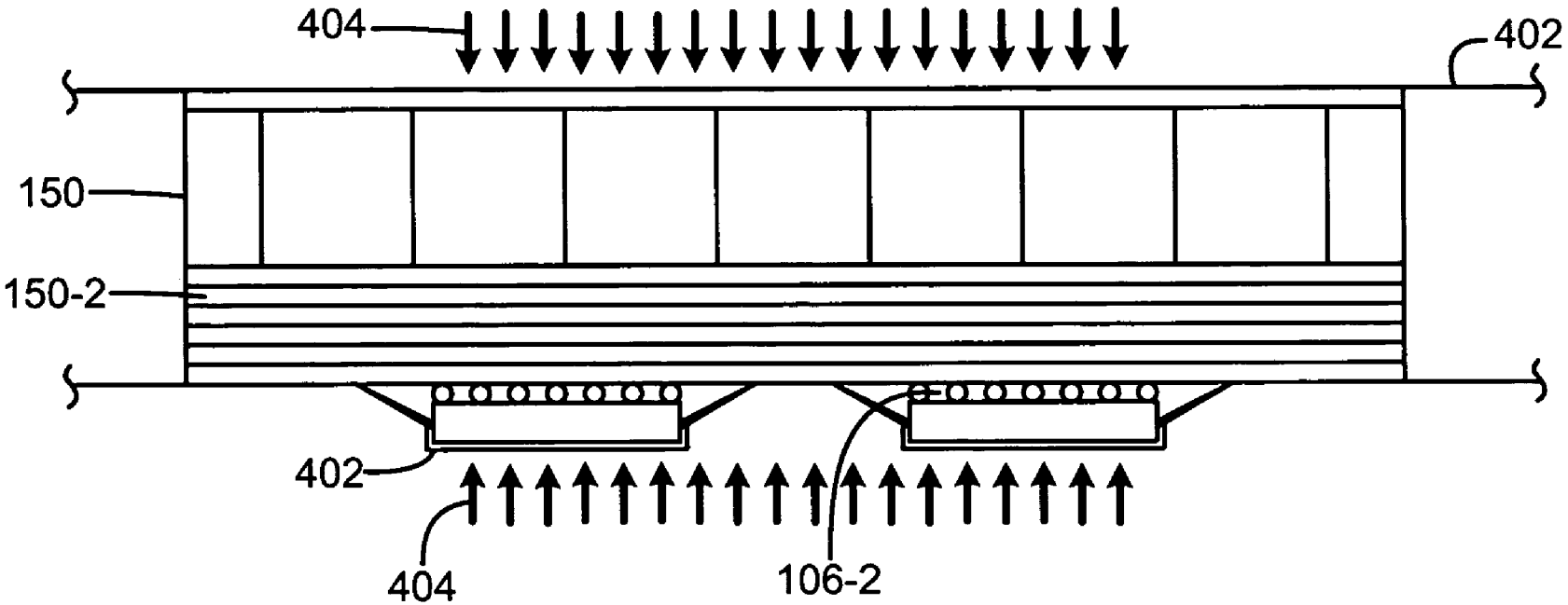

FIGS. 5A-5D illustrates an exemplary process for mounting the active subarray panel assembly onto the aperture using adhesive containing the microwave interconnects. FIG. 5A shows the aperture assembly 150 disposed in spaced relation to the subarray assemblies 100, each of which has the T/R chips 160 attached. FIG. 5B shows the aperture and the subarray assemblies brought into contact with an adhesive layer 150-2 which contains the interconnects. An exemplary adhesive material suitable for the purpose is Dupont™ Pyralux™ bondply, with a conductive ink used to form the interconnects. The interconnects form electrical connections between an array of contact pads on the bottom surface of the aperture and a corresponding array of contact pads on the top surface of the subarray assembly 100. FIG. 1C diagrammatically illustrates an exemplary array of contact pads 152 on the bottom surface of an aperture assembly, and an exemplary array of contact pads 142 on the top surface of a subarray assembly 100. Corresponding ones of the contact pads 152 and 142 are electrically connected by conductive inks during the assembly process. FIG. 1A also depicts an exemplary form of a contact pad arrangement 142-1 which includes a center pad and several surrounding pads which may form an exemplary coaxial interconnect arrangement.

In an exemplary embodiment, once the subarray panels and aperture are assembled together, the curing of the adhesive and engagement of the microwave interconnects is accomplished with pressure, heat and vacuum applied using autoclave molding techniques. The active panel array antenna assembly (subarrays with aperture) is placed in a vacuum bag 402 in which all the air is drawn out by vacuum pump 406. The vacuum bag may provide both pressure, up to 14.7 psi at ground level, atmospheric pressure, and vacuum. If the bag with the assemblies is placed in an autoclave, higher pressures can be exerted, e.g. on the order of 25 to 30 psi. The pressure applied may be normal to the bag's surface and uniform across the surface of the bag, as generally indicated by arrows 404 (FIG. 5C). The pressure compacts the panel assembly, providing good consolidation and interpanel bond. The vacuum draws out volatiles and trapped air with the adhesive interface, resulting in low void content at the adhesive interface. Heat and higher pressures may be applied to the panel assembly when it is placed in the chamber 412 of an autoclave 410. FIG. 5C depicts the bag 402 as well as the aperture, the panel subassemblies and the T/R chips inside the autoclave, before air is evacuated from the bag. An autoclave is a pressurized device that heats the assembly to the adhesive curing temperatures. Although an autoclave is a sealed vessel, it usually has an opening for injection of gases or liquids and a vent to control the pressure. FIG. 5D diagrammatically depicts the bag 402 in an evacuated state.

Autoclave molding can be applied to the active subarray panel assembly with the TR flip chips mounted on the panel surface. The underfill epoxy 160-2 (FIG. 5D) underneath the TR flip chip distributes the force needed to counteract the pressure imposed by the vacuum bag.

The vacuum bag 402 may be constructed of a flexible impermeable material such as Mylar™ (e.g. 7 mil thickness) or Kapton™ (e.g. 2 mil thickness). Of course, other flexible materials may also be used.

Figure 6:
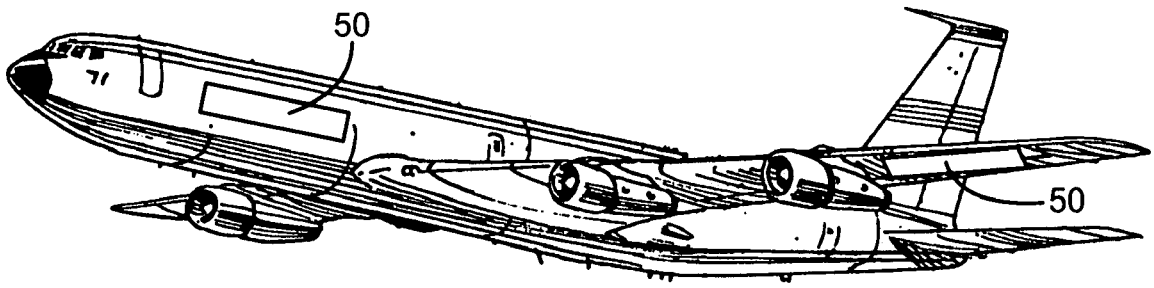
FIG. 6 depicts an exemplary embodiment of an aircraft in which arrays are incorporated in the wing and fuselage surfaces.

Exemplary applications for arrays fabricated with one or more of the processes described above include airplane wing, fuselage as well as many other surfaces that may carry mechanical loads. FIG. 6 depicts an aircraft in which arrays 50 are incorporated in the wing and fuselage surfaces.

Although the foregoing has been a description and illustration of specific embodiments of the subject matter, various modifications and changes thereto can be made by persons skilled in the art without departing from the scope and spirit of the invention as defined by the following claims.

What is claimed is:

1. A method for assembling an active array system comprising:

providing an active subarray panel assembly having a first surface with a first array of electrical contacts;

providing a radiator aperture comprising a radiator surface with an array of radiator structures and an aperture mounting surface, opposing the radiator surface, with a second array of electrical contacts;

bringing the first surface of the panel assembly and the aperture mounting surface of the radiator aperture into contact with an adhesive layer including microwave interconnects in a pattern corresponding to the first array of electrical contacts and the second array of electrical contacts so that the adhesive layer is between the first surface of the panel assembly and the aperture mounting surface of the radiator aperture; and applying pressure, heat and vacuum to the panel assembly, the adhesive layer and the radiator aperture to cure the adhesive and complete engagement of the microwave interconnects with the first array of electrical contacts and the second array of electrical contacts.

2. The method of claim 1, wherein said applying pressure, heat and vacuum comprises:

placing the subarray panel assembly, the adhesive layer and the radiator aperture in a vacuum bag;

evacuating air from the vacuum bag.

3. The method of claim 2, wherein evacuating air from the vacuum bag results in providing pressure to said panel assembly and to said radiator aperture.

4. The method of claim 3, wherein said pressure does not exceed 14.7 psi.

5. The method of claim 2, wherein said applying pressure, heat and vacuum applies pressure normal to the bag's surface and substantially uniformly across a surface of the bag.

6. The method of claim 2, wherein:

said evacuating air from said vacuum bag draws out volatiles and trapped air in interfaces between the adhesive layer and the subarray panel assembly and between the adhesive layer and the radiator aperture.

7. The method of claim 2, wherein said applying pressure, heat and vacuum further comprises:

placing said vacuum bag with the subarray panel assembly, the adhesive layer and the radiator aperture in an autoclave; and pressurizing the autoclave to a pressure exceeding atmospheric pressure.

8. The method of claim 1, wherein the subarray panel assembly includes a second surface opposed to said first surface, and a plurality of active integrated circuit chips surface mounted to said second surface of the subarray panel assembly.

9. The method of claim 8, wherein said integrated circuit chips are attached to said second surface by an underfill epoxy which distributes a reaction force counteracting said pressure.

10. The method of claim 1, wherein the radiator aperture includes an egg-crate radiator array and a dielectric face sheet assembled to said egg-crate radiator array.

11. The method of claim 1, wherein said adhesive layer comprises a bondply layer.

12. The method of claim 1, wherein said microwave interconnects are formed by a Z-axis conductive film, selectively screen printable conductive epoxy, solder or electrically conductive sintered paste interconnects.

13. The method of claim 8:

wherein an outer surface of the subarray panel assembly, the outer surface comprising a top surface of the plurality of integrated circuit chips and portions of the second surface not covered by the plurality of integrated circuit chips, is uneven;

wherein the applying pressure, heat and vacuum comprises:

placing the subarray panel assembly, the adhesive layer and the radiator aperture in a vacuum bag; and evacuating air from the vacuum bag; and wherein the evacuating air from the vacuum bag provides even pressure to the uneven outer surface of the subarray panel assembly.

* * * * *

UNITED STATES PATENT AND TRADEMARK OFFICE

CERTIFICATE OF CORRECTION

PATENT NO. : 7,631,414 B2
APPLICATION NO. : 11/891774
DATED : December 15, 2009
INVENTOR(S) : Avery Y. Quil et al.

It is certified that error appears in the above-identified patent and that said Letters Patent is hereby corrected as shown below:

Col. 1, lines 3-5

Before "Cross-Reference To Related Application(s)", please add the following paragraph:

STATEMENT REGARDING FEDERALLY SPONSORED RESEARCH

This invention disclosure is related to Government contract number F33615-02-2-3220. The U.S. Government has certain rights in this invention.

Signed and Sealed this
Second Day of October, 2012

David J. Kappos

David J. Kappos
*Director of the United States Patent and Trademark Office*